US006258188B1

(12) United States Patent
Hatcher et al.

(10) Patent No.: US 6,258,188 B1
(45) Date of Patent: Jul. 10, 2001

(54) SOLID FUEL GAS GENERATOR FOR DUCTED ROCKET ENGINE

(75) Inventors: Richard C. Hatcher, New Hope; William D. Stephens, Huntsville; Robert L. Stanley, Huntsville, all of AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/415,708

(22) Filed: Oct. 12, 1999

(51) Int. Cl.[7] ..... C06B 45/10; C06B 41/00; C06B 25/00

(52) U.S. Cl. ..... 149/19.4; 149/19.6; 149/23; 149/88; 149/19.9; 149/19.4

(58) Field of Search ..... 60/207, 208; 149/19.4, 149/19.6, 23, 88

(56) References Cited

U.S. PATENT DOCUMENTS 3,705,495 * 12/1972 Greiner et al. ..... 60/214
3,754,511 * 8/1973 Damon et al. ..... 102/102
4,707,540 * 11/1987 Manser et al. ..... 528/417
4,747,891 * 5/1988 Fink et al. ..... 149/19.4
4,764,586 * 8/1988 Manser et al. ..... 528/362
4,916,206 * 4/1990 Day et al. ..... 528/272
4,925,909 * 5/1990 Kuboto et al. ..... 528/55
4,944,815 * 7/1990 Consaga ..... 149/19.1
5,152,136 10/1992 Chew et al. ..... 60/251
5,439,537 * 8/1995 Hinshaw et al. ..... 149/22
5,467,714 * 11/1995 Lund et al. ..... 102/284
5,487,798 * 1/1996 Williams ..... 149/22
5,498,303 * 3/1996 Hinsaw et al. ..... 149/19.6
5,500,061 * 3/1996 Warren et al. ..... 149/19.4
5,516,378 * 5/1996 Henry, III et al. ..... 149/22
5,798,480 * 8/1998 Willer et al. ..... 149/19.4

* cited by examiner

*Primary Examiner*—Michael J. Carone
*Assistant Examiner*—Glenda L. Sanchez
(74) *Attorney, Agent, or Firm*—Arthur H. Tischer; Freddie M. Bush

(57) ABSTRACT

In the development of new minimum signature ducted rocket technology, the U.S. Army MICOM Propulsion Directorate has conducted studies for the development of fuel-rich gas generators for ducted rockets. The propellant formulation goals of this study include increasing burning rate, pressure exponent, and combustion efficiency without significantly decreasing fuel value. Formulations described in this application contain an energetic nitramine-prepolymer, a range of curing agents, and zirconium hydride ($ZrH_2$) fuel element and carbon (C) as an optional fuel element.

3 Claims, No Drawings

SOLID FUEL GAS GENERATOR FOR DUCTED ROCKET ENGINE

DEDICATORY CLAUSE

The invention described herein may be manufactured, used, and licensed by or for the Government for governmental purposes without the payment to us of any royalties thereon.

BACKGROUND OF THE INVENTION

The U.S. Army MICOM has conducted investigations in the development of fuel-rich gas generator formulations for minimum signature and smokey ducted rockets. The majority of work has primarily involved the incorporation of carbon as a fuel in a binder system based on glycidyl azide polymer (GAP). Goals of the ducted rocket engine formulations include high delivered volumetric heating values, tailorable burning rates and exponents, low temperature sensitivity, good mechanical properties, low combustion chamber temperatures, and good ignitability over a wide temperature range.

SUMMARY OF THE INVENTION

In studies conducted by MICOM, nitramine-containing prepolymers such as ORP-2 and 9-D, T-NIDA were evaluated as alternatives to GAP. These studies show ORP-2 and 9-D, T-NIDA to have superior compatibility and mechanical properties to GAP while still offering the low combustion temperatures which made GAP of interest initially. These formulations also contain zirconium hydride, $ZrH_2$, as a fuel additive. $ZrH_2$ has been demonstrated to improve ignitability relative to standard carbon-containing formulations. Based on the results of initial tests with these ingredients, a formulation range (TABLE 3) has been developed. Examples of formulations derived from this formulation range are outlined below in TABLE 1. These examples demonstrate the theoretical performance [specific impulse, (Isp), impulse density, (IspD), chamber temperature, (Tcham), and exhaust temperature, (Texit)] available with combinations of these ingredients and the resulting theoretical concentration of exhaust products.

DESCRIPTION OF THE PREFERRED EMBODIMENT(s)

Examples of formulations derived from the formulation ranges of Table 3 are shown in Table 1 along with the combustion products and some relative performance characteristics. Table 2 lists additional performance characteristics. The ingredients with abbreviations shown in Table 1, Table2, and Table 3 are identified hereinbelow under "Table: Ingredients Defined" prior to the listing of ingredients set forth in Tables 1–3.

TABLE

| Ingredients Defined | |
|---|---|
| ORP-2 | a nitramine-containing prepolymer based on undecanedioc acid as detailed in U.S. Pat. No. 4,916,206 issued to Day and Hani. |
| CARBON | carbon black |
| HMDI | hexamethylene diisocyanate |
| IPDI | Isophorone diisocyanate |
| N100 | a polyfunctional isocyanate which is the reaction product of hexamethylene diisocyanate and water |
| $ZrH_2$ | zirconium hydride as fuel additive |
| DBTDL | dibutyl tin dilaurate, curing catalyst |
| 9-D, T-NIDA | nitramine-containing prepolymer based on nitraminodiacetic acid, diethylene glycol, and triethylene glycol. |

TABLE 1

| INGREDIENT | % | % | % |
|---|---|---|---|
| ORP-2 | 82.65 | 78.30 | 82.65 |
| N100 | 12.34 | 11.69 | 12.34 |
| C | 5 | 0 | 3 |
| $ZrH_2$ | 0 | 10 | 2 |
| DBTDL | 0.01 | 0.01 | 0.01 |
| PERFORMANCE VALUE | | | |
| Isp(sec) | 140.2 | 149.8 | 143.2 |
| IspD | 6.7 | 7.6 | 6.9 |
| Tcham(K) | 999 | 1105 | 1024 |
| Texit(K) | 664 | 760 | 687 |
| EXHAUST PRODUCT | WEIGHT % | WEIGHT % | WEIGHT % |
| C | 33.31 | 27.28 | 31.35 |
| $CH_4$ | 0.19 | 8.54 | 10.05 |
| CO | 0.23 | 1.56 | 0.38 |
| $CO_2$ | 18.78 | 17.08 | 18.83 |
| $H_2$ | 0.65 | 1.57 | 0.83 |
| $H_2O$ | 22.54 | 17.21 | 21.63 |
| $N_2$ | 14.29 | 13.53 | 14.29 |
| $ZrO_2$ | 0 | 13. | 2.64 |

The theoretical values shown are within the acceptable ranges for the application of these formulations to solid fuel gas generators.

Solid fuel gas generator formulations are also characterized by their theoretical volumetric and gravimetric heating values. Theoretical heating values for the formulations described above in TABLE 1 are outlined in TABLE 2.

TABLE 2

| INGREDIENT | % | % | % |
|---|---|---|---|
| ORP-2 | 82.65 | 78.3 | 82.65 |
| N100 | 12.34 | 11.69 | 12.34 |
| C | 5 | 0 | 3 |
| $ZrH_2$ | 0 | 10 | 2 |
| DBTDL | 0.01 | 0.01 | 0.01 |
| PERFORMANCE VALUE | | | |
| VHV, BTU/in3 | 441 | 425 | 431 |
| GHV, BTU/lb | 9188 | 8598 | 9018 |

TABLE 3

| INGREDIENT | RANGE (%) |
|---|---|
| ORP-2 | 60–85 |
| N100 | 5–15 |
| HMDI | 5–15 |
| IPDI | 5–15 |
| $ZrH_2$ | 0.5–10 |
| C | 0–30 |

In a comparison with other binder systems (prepolymer with curing agents), it has been determined that energetic nitramine containing binders offer advantages over current ducted rocket engine fuel gas generator formulations and lead to improved overall performance. These advantages include superior compatibility and mechanical properties without adversely affecting low temperature combustion. Because of these advantages and the initial test results which show that combinations of ORP-2 with $ZrH_2$, in solid fuel gas generators display improved ignitability relative to standard carbon containing formulations, we claim this combination as unique and more suitable for solid fuel gas generators.

While the present invention is outlined by specifications listed in TABLE 3, it is not intended to be limited specifically to this range. There are many variations possible within the scope of the claims.

EXAMPLE 1

| Ingredients | Weight Percents |
|---|---|
| Nitramine-containing prepolymer based on undecanedioc acid | 82.65 |
| Polyfunctional isocyanate (reaction product of Hexamethylene diisocyanate and water) | 12.34 |
| Carbon black | 3 |
| Zirconium hydride as fuel additive | 2 |
| Dibutyl tin dilaurate curing catalyst | 0.01 |

EXAMPLE 2

| Ingredients | Weight Percents |
|---|---|
| Nitramine-containing prepolymer based on undecanedioc acid | 78.30 |
| Polyfunctional isocyanate (reaction product of Hexamethylene diisocyanate and water) | 11.69 |
| Zirconium hydride as fuel additive | 10 |
| Dibutyl tin dilaurate curing catalyst | 0.01 |

We claim:

1. A solid fuel gas generator for ducted rocket engine comprising a range in weight percent of the following ingredients:

i. an energetic nitramine prepolymer binder in the amount from 60–85 weight percent of the gas generator composition;

ii. a curing and crosslinking agent selected from the group of curing and crosslinking agents consisting of hexamethylene diisocyanate, a polyfunctional isocyanate which is the reaction product of hexamethylene and water, and isophorone diisocyanate 5–15 weight percent of the gas Generator composition;

iii. $ZrH_2$ fuel additive and ignition aid of about, 0.5–10 weight percent of the gas generator composition;

iv. carbon black fuel element of about 0–30 weight percent of the gas generator composition; and, v. a curing catalyst of dibutyl tin dilaurate 0.01 weight percent of the gas generator composition.

2. The solid fuel gas generator for ducted rocket engine as defined in claim 1 wherein said energetic nitramine prepolymer binder is present in weight percent amount of about 82.65; wherein said curing and crosslinking agent is said polyfunctional isocyanate which is present in weight percent amount of 12.34; wherein said carbon black is present in weight percent amount of 3; wherein said $ZrH_2$ is present is present in weight percent amount of 2; and wherein said curing catalyst dibutyl tin dilaurate is present in weight percent amount of 0.01.

3. The solid fuel gas generator for ducted rocket engine as defined in claim 1 wherein said energetic nitramine prepolymer binder is present in weight percent amount of about 78.30; wherein said curing and crosslinking agent is said polyfunctional isocyanate which is present in weight percent amount of 11.69; wherein said $ZrH_2$ is present in weight percent amount of 10; and wherein said curing catalyst dibutyl tin dilaurate is present in weight percent amount of 0.01.

* * * * *